US006663084B1

(12) United States Patent
Butler

(10) Patent No.: US 6,663,084 B1
(45) Date of Patent: Dec. 16, 2003

(54) WALLBOARD JACK AND HOLDING APPARATUS

(76) Inventor: Rick A. Butler, 4320 Linthicum Rd., Dayton, MD (US) 21036

( * ) Notice: Subject to any disclaimer, the term of this patent is extended or adjusted under 35 U.S.C. 154(b) by 0 days.

(21) Appl. No.: 10/207,893

(22) Filed: Jul. 31, 2002

Related U.S. Application Data

(60) Provisional application No. 60/310,969, filed on Aug. 9, 2001.

(51) Int. Cl.[7] ..... B66F 3/08
(52) U.S. Cl. ..... 254/100
(58) Field of Search ..... 254/100, 98, 133 R; 414/11

(56) References Cited

U.S. PATENT DOCUMENTS 2,013,918 A * 9/1935 Kelleher ..... 254/98
3,810,603 A * 5/1974 Metz ..... 254/100
4,712,771 A 12/1987 Donnelly et al.
4,868,943 A 9/1989 Robichaud
5,814,842 A 9/1998 Muldoon et al.

* cited by examiner

*Primary Examiner*—Robert C. Watson
(74) *Attorney, Agent, or Firm*—Donald A Kettlestrings

(57) ABSTRACT

A jack for raising, lowering and holding articles such as wallboard can be used by a single installer to install a wall-board panel. The wallboard panel is lifted by turning a knob that moves a foot member down against the floor to lift the wallboard. The installer can easily make small adjustments of the wallboard position by turning the knob to raise or lower the wallboard panel.

16 Claims, 2 Drawing Sheets

WALLBOARD JACK AND HOLDING APPARATUS

This application claims the benefit of Provisional application Ser. No. 60/310,969, filed Aug. 9, 2001.

BACKGROUND OF THE INVENTION

This invention relates to construction tools and more particularly to a hand operated jack for lifting, lowering, positioning and holding items such as wallboard for installation by a single installer.

Various types of wallboard jacking devices are known for lifting and holding wallboard during the installation process. Although such devices have served the purpose, they have not proved entirely satisfactory because they require the installer to press downwardly on a lever to lift and hold the wallboard into position. Use of the installer's body weight to lift the wallboard results in fatigue of the installer over time when a plurality of wallboard panels are being installed. Also, more than one installer is required when using some prior art jack devices because one worker is required to hold the wallboard in position while maintaining his weight on the lifting lever while a second worker installs appropriate fastening devices to the wallboard.

When using such prior art jack devices it is also difficult to make fine tuned or small adjustments to the position of the wallboard as it is being installed. This is because it is difficult for the installer to manipulate the foot lever of the prior art devices in such a way that the wallboard can be raised or lowered in small increments to properly position the wallboard prior to installation.

It is, therefore, an object of the present invention to provide a wallboard jack for lifting, lowering, positioning and holding wallboard panels during installation.

Another object is to provide such apparatus which can enable wallboard to be installed by a single installer.

A further object of the invention is the provision of such apparatus which reduces installer fatigue during the installation process by enabling the installer to lift or lower the wallboard by turning a hand knob instead of using the installer's weight on a lever to lift, lower and hold the wallboard in position.

Still another object is to provide such an apparatus which enables fine tuned or small adjustments of the wallboard's position by merely turning the knob to raise or lower the wall-board.

A further object is to provide such an apparatus which screws a foot member down against the floor to cause a lifting of the wallboard instead of requiring the installer to use his body weight to lift the wallboard.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides a wallboard jack and holding apparatus which comprises: a first housing having a first plurality of sidewalls or supports and a top wall member connected to predetermined ones of the sidewalls or supports, the top wall member defining a first threaded opening therein; a rod extending through the first opening and defining an exterior, threaded surface threadably engaging the first opening and further defining first and second ends; a foot member connected to the first end of the rod; a handle connected to the second end of the rod; and a flange member connected to a first one of the sidewalls or supports.

It is to be understood that both the foregoing general description and the following detailed description are exemplary and explanatory but are not restrictive of the invention.

BRIEF DESCRIPTION OF THE SEVERAL VIEWS OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE INVENTION

Figure 1:
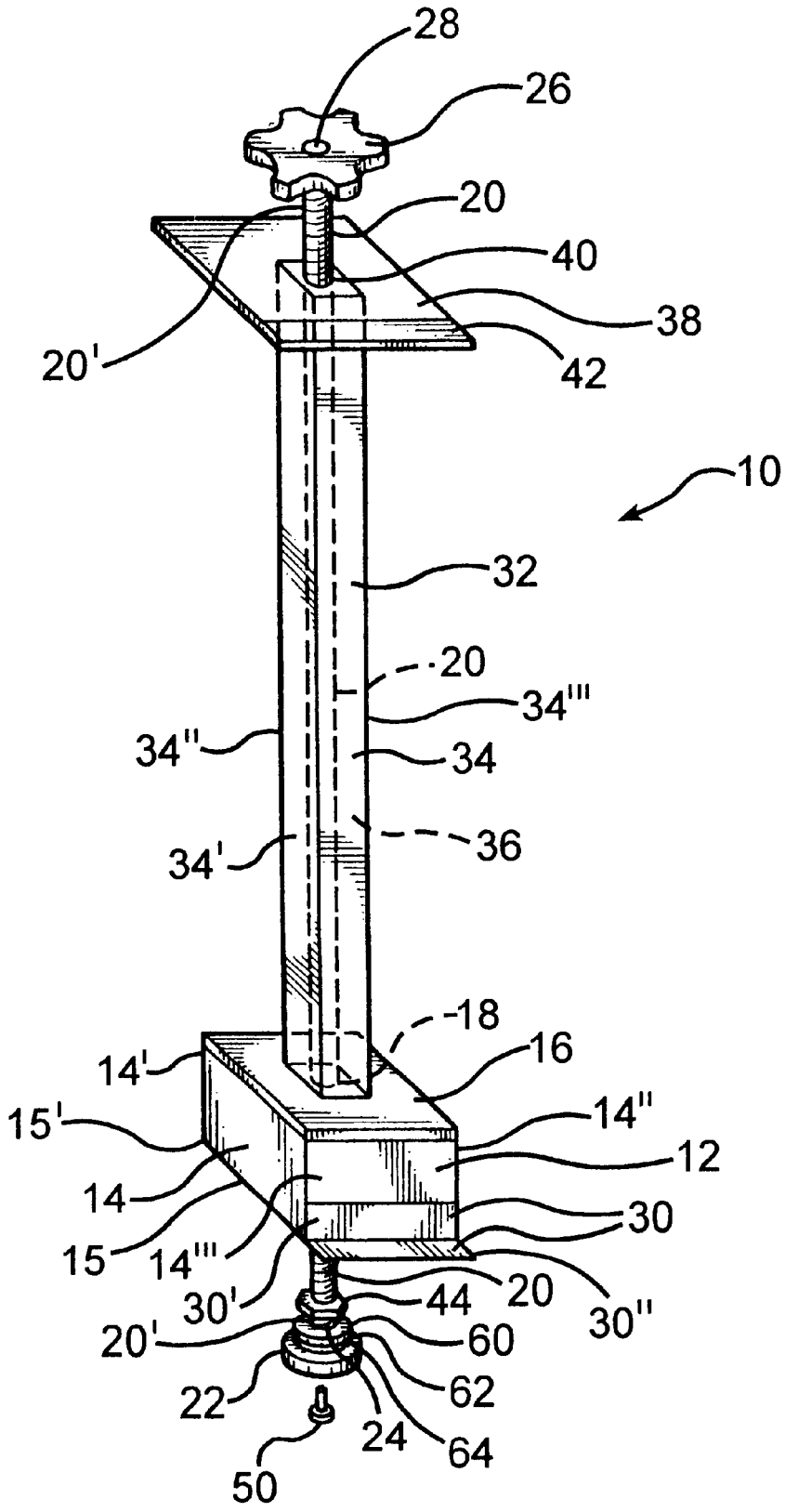
FIG. 1 is a partially exploded perspective view of the wallboard jack and holding apparatus.
Figure 2:
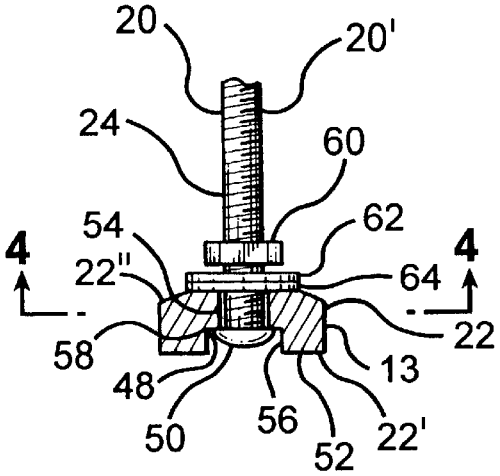
FIG. 2 is a fragmentary cross sectional view of a portion of the apparatus and showing the foot member in more detail.
Figure 4:
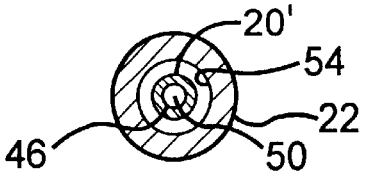
FIG. 4 is a cross sectional view taken on the line 4—4 in FIG. 2 looking in the direction of the arrows.
Figure 3:
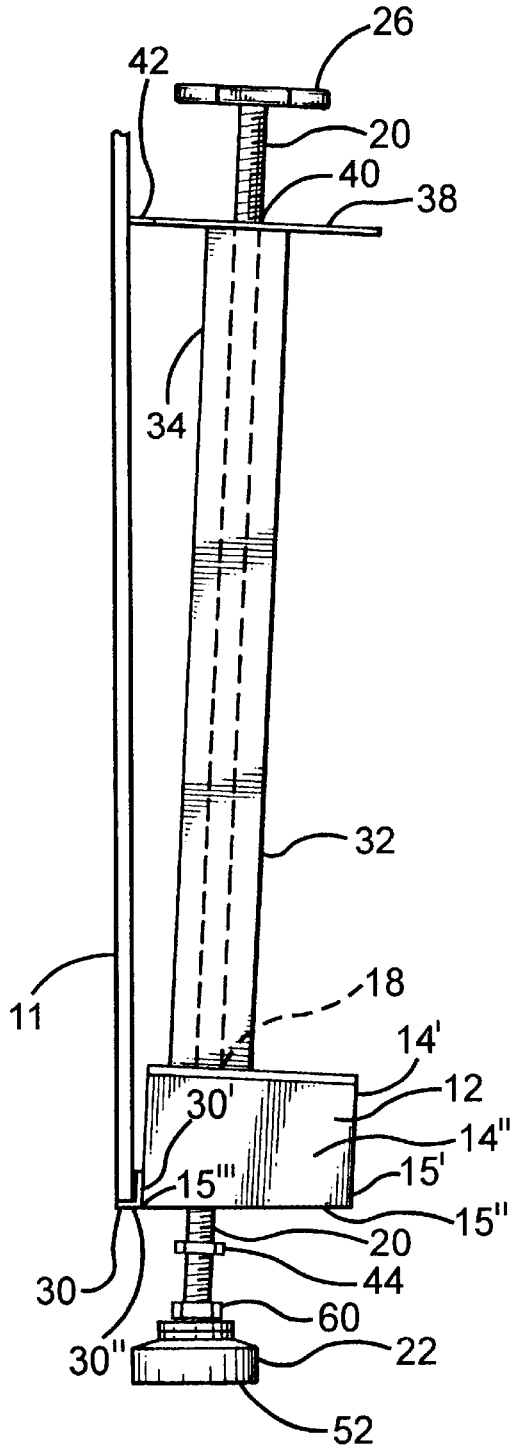
FIG. 3 is a side elevation view showing the apparatus lifting a wallboard panel.

With reference now to the drawings, wherein like reference characters designate like or corresponding parts throughout the several views, there is shown a wallboard jack and holding apparatus 10 in accordance with this invention.

Apparatus 10 includes a first housing 12 having a first plurality of sidewalls or supports 14, 14', 14" and 14'" conventionally connected together. Housing 12 further includes a top wall member 16 conventionally connected to the sidewalls or supports, and top wall member 16 defines a first threaded opening 18 therein. The bottom of housing 12 is open.

Bottom edeges surfaces 15, 15" of sidewalls or supports 14, 14" can be bevelled or slanted upwardly from sidewall or support 14'" toward sidewall or support 14' so that the height of sidewall or support 14' is less than the height of sidewall or support 14'" by approximately one-eighth of an inch. The one-eighth of an inch will vary depending upon the overall height of apparatus 10 so that when apparatus 10 is inserted under panel 11, portion 30' will contact panel 11 before or at the same time as spacer edge element 42 of member 38 contacts panel 11.

Apparatus 10 further comprises a rod 20 which extends through opening 18 and which defines an exterior, threaded surface 20' which threadably engages opening 18.

Apparatus 10 further includes a foot member 22 connected to a first end 24 of rod 20, and a handle 26 conventionally connected to a second end 28 of rod 20. Apparatus 10 further includes a flange member 30 conventionally connected to a first one 14'" of the sidewalls. Flange member 30 can be formed from an L-shaped element having an upper portion 30' conventionally attached to sidewall or support 14'" and which extends slightly below lower edge surface 15'" of sidewall or support 14'" by about one-eighth of an inch. The one-eighth of an inch will vary depending upon the overall height of apparatus 10 so that when apparatus 10 is inserted under panel 11, portion 30' will contact panel 11 before or at the same time as spacer edge element 42 of member 38 contacts panel 11. This configuration can be provided as an alternative to slanting or bevelling bottom edges surfaces 15, 15" as previously described. If portion 30' extends slightly below lower edge surface 15'" , then bottom edges surfaces 15, 15" will not be bevelled and will be straight so that the height of sidewall or support 14' will be the same as the height of sidewalls or supports 14, 14" and 14'". Lower portion 30" of flange member 30 preferably extends outwardly from upper portion 30' a distance equal to the thickness of a standard wallboard panel 11 so that apparatus 10 will only lift panel 11 and will not try to lift the wall framing to which panel 11 will be attached.

Apparatus 10 further comprises a second housing 32 having a second plurality of sidewalls or supports 34, 34', 34" and 34'" conventionally connected together to form an interior space 36, and sidewalls or supports 34, 34', 34" and 34'" are conventionally connected to top wall member 16 with interior space 36 in fluid communication with first opening 18. Rod 20 is positioned within and extends through interior space 36.

Apparatus 10 further comprises a spacer member 38 conventionally connected to sidewalls or supports 34, 34', 34" and 34'", and spacer member 38 defines a second opening 40 therein in fluid communication with interior space 36. Rod 20 extends through opening 40.

A protective edge element 42 is conventionally connected to spacer member 38 for engaging the wallboard being installed with apparatus 10 without damaging that wallboard. Edge element 42 is preferably comprised of or coated with a rubber or plastic material, such as vinyl.

Spacer member 38 is preferably a substantially flat, rigid member which extends beyond all of sidewalls or supports 34, 34', 34" and 34'" and beyond handle 26 to provide space between the wallboard being installed by apparatus 10 and handle 26 to facilitate turning of the handle by a user of apparatus 10 and to prevent handle 26 from striking the floor and possible bending of rod 20 if apparatus 10 were to fall over from an upright position.

Apparatus 10 further includes a stop member 44 connected to rod 20 between foot member 22 and opening 18. Stop member 44 is preferably adjustably connected to rod 20 and may be a threaded nut which threadably engages exterior threaded surface 20' of rod 20. Stop member 44 will contact top wall member 16 to limit upward movement of rod 20.

Rod 20 defines a longitudinal axis, and foot member 22 is preferably movably connected to end 24 of rod 20 for enabling foot member 22 to rotate, pivot and move axially with respect to the longitudinal axis of rod 20.

First end 24 of rod 20 defines a third threaded opening 46 therein in substantial alignment with the longitudinal axis of rod 20, and foot member 22 defines a fourth opening 48 therein. A screw 50 is positioned within opening 48 and threadably engages threaded opening 46 for holding foot member 22 onto end 24 of rod 20.

Foot member 22 defines a bottom surface 52 contiguous with opening 48 and screw 50 is preferably recessed within opening 48 with respect to bottom surface 52.

Fourth opening 48 defines an upper portion 54 of a predetermined length and having a diameter larger than the external diameter of rod 20. Opening 48 further defines a lower portion 56 having a diameter greater than the diameter of upper portion 54, and foot member 22 defines an annular surface 58 between upper and lower portions 54, 56 for engaging a head of screw 50 when screw 50 is threaded into opening 46 so that screw 50 prevents foot member 22 from sliding off of rod 20.

Apparatus 10 further includes a locknut 60 threadably positioned on rod 20 adjacent to first end 24 of rod 20. A first washer 62, preferably made of metal and of predetermined thickness, is positioned on rod member 20 between locknut 60 and foot member 22. A second washer or a coating 64 on top surface 22" of foot member 22, preferably comprised of a low-friction material such as Teflon® and of predetermined thickness, is positioned around rod member 20 between washer 62 and foot member 22.

The distance between annular surface 58 and locknut 60 is greater than the total of the length of upper portion 54 of opening 48 and the combined thicknesses of washers 62 and 64 to permit foot member 22 to move axially with respect to the longitudinal axis of rod 20. Because the diameter of upper portion 54 of opening 48 is greater than the external diameter of rod 20, foot member 22 can also pivot and rotate with respect to the longitudinal axis of rod 20.

Washer or coating 64 and bottom surface 52 of foot member 22 are preferably comprised of a low-friction material, such as Teflon® or polytetrafluoroethylene.

In operation and use of apparatus 10, wallboard panels are conventionally attached to ceilings without use of apparatus 10. Wallboard panels 11 to be mounted in vertical positions will first be located on the floor directly below where the wallboard panel is to be vertically mounted. Apparatus 10 is then placed into position by sliding flange member 30 under the bottom edge of the wallboard panel and approximately near the center of the wallboard panel. If the wallboard panel is resting on the floor, the installer can kick or hit sidewall or support 14' with a hammer until flange member 30 is under the wallboard panel.

If bottom edges surfaces 15, 15" are bevelled, or alternatively, if portion 30' extends below lower edge surface 15'", then the top of apparatus 10 will be slightly angled away from the wallboard panel as it rests on the floor. As a result, when apparatus 10 is kicked under the wallboard panel, portion 30' will contact the wallboard panel before or at the same time as spacer edge element 42 of spacer member 38. Also, because spacer edge element 42 of member 38 is positioned further from wall member 34 than is sidewall 14'", handle 26 is angled away from panel 11 so that the installer can position his hand on handle 26 and between handle 26 and panel 11.

Handle 26 is then manually turned in a clockwise direction by the installer which causes apparatus 10 and the wallboard panel to be raised as foot member 22 remains positioned on the floor. Handle 26 is turned until the wallboard panel is raised to the desired elevation or until it butts against the ceiling wallboard panels. Turning handle 26 causes threaded rod 20 to threadably move through threaded opening 18 to raise apparatus 10, as described, while foot member 22 remains on the floor.

At this point, the installer is free to walk away from the wallboard panel and from apparatus 10 to make sure that the wallboard panel fits properly and is properly positioned. The installer can then fasten the wallboard panel to the wall studs (not shown) in a conventional manner. After the wallboard panel has been attached to the studs, the installer can turn handle 26 in a counterclockwise direction to lower apparatus 10 with respect to foot member 22 and with respect to the floor. Flange member 30 can then be removed from beneath the wallboard panel.

While installing a wallboard panel, apparatus 10 can be adjusted upwardly or downwardly by turning handle 26 to fine-tune or to make small adjustments to the position of the wallboard panel. Because foot member 22 is adjustably and movably connected to rod 20, apparatus 10 can be vertically oriented when installing the wallboard panels even though the floor may be uneven or not precisely horizontal.

When apparatus 10 is lifted off the floor with the wallboard panel by turning handle 26, foot member 22 remains on the floor and does not rotate on the floor. Handle 26, rod 20, stop member 44, locknut 60, washer 62 and screw 50 will all rotate together. A Teflon® washer or a Teflon® coating 64 on top surface 22" of foot member 22 and foot member 22 will not rotate as handle 26 is turned. As a result, frictional forces occur between steel washer 62 and Teflon® washer or coating 64 as handle 26 is turned. This minimizes friction and avoids metal rubbing against metal. A low-friction material other than Teflon® could be used for washer or coating 64.

A bottom surface 22' of foot member 22 is preferably made of or coated with Teflon® or other low-friction material to enable foot member 22 to slide easily over the floor surface. Screw 50 is recessed within opening 40 of foot member 22 so that screw 50 does not contact the floor.

Rod 20, spacer member 38, housing 32, top wall member 16, housing 12, flange member 30, stop member 44, locknut 60, washer 62, foot member 22 and screw 50 are preferably made of steel or other appropriate metal or material. Handle 26 is preferably made of cast aluminum or plastic. Edge element 42 is preferably comprised of or coated with plastic or rubber material. Apparatus 10 can be made in various sizes, and will stand upright on its own when not in use to eliminate the need for the installer to bend over to pick it up each time the apparatus is used. This is accomplished by making housing 12 large enough to support apparatus 10 in an upright position when foot member 22 is retracted into housing 12.

The invention in its broader aspects is not limited to the specific details shown and described, and departures may be made from such details without departing from the principles of the invention and without sacrificing its chief advantages.

What is claimed is:

1. A wallboard jack and holding apparatus comprising:

a first housing having a first plurality of supports and a top wall member connected to predetermined ones of said supports, said top wall member defining a first threaded opening therein;

a rod extending through said first opening and defining an exterior, threaded surface threadably engaging said first opening and further defining a longitudinal axis and first and second ends;

a foot member connected to said first end of said rod;

a handle connected to said second end of said rod;

a flange member connected to a first one of said supports;

a second housing having a second plurality of supports connected together to form an interior space and wherein predetermined ones of said second plurality of supports are connected to said top wall member; and wherein said rod is positioned within and extends through said interior space.

2. Apparatus as in claim 1 further comprising:

a spacer member connected to predetermined ones of said second plurality of supports and defining a second opening therein; and wherein said rod extends through said second opening and into said interior space.

3. Apparatus as in claim 2 further including a protective edge element connected to said spacer member for engaging the wallboard being installed with said apparatus without damaging that wallboard.

4. Apparatus as in claim 3 further including a stop member connected to said rod between said foot member and said first opening.

5. Apparatus as in claim 3 wherein said spacer member is a substantially flat member which extends beyond all of said second plurality of supports of said second housing and beyond said handle to provide space between the wallboard being installed by said apparatus and said handle to facilitate turning of said handle by a user of said apparatus and to prevent said handle from striking the floor and possible bending of said rod if said apparatus were to fall over from an upright position.

6. Apparatus as in claim 1 wherein said foot member is movably connected to said first end of said rod for enabling said foot member to rotate, pivot and move axially with respect to said rod's axis.

7. Apparatus as in claim 6 wherein said first end of said rod defines a third threaded opening therein in substantial alignment with said rod's axis and wherein said foot member defines a fourth opening therein, and a screw positioned within said fourth opening and threadably engaging said third threaded opening for holding said foot member onto said first end of said rod.

8. Apparatus as in claim 7 wherein said foot member defines a bottom surface contiguous with said fourth opening and wherein said screw is recessed within said fourth opening with respect to said bottom surface.

9. Apparatus as in claim 8 wherein said fourth opening defines an upper portion of predetermined length and having a diameter larger than a diameter of said rod.

10. Apparatus as in claim 9 wherein said fourth opening further defines a lower portion having a diameter larger than said upper portion, and wherein said foot member defines an annular surface between said upper and lower portions of said fourth opening for selectively engaging a head of said screw, whereby said screw prevents said foot member from sliding off of said rod.

11. Apparatus as in claim 10 further including:

a locknut threadably positioned on said rod adjacent to said first end of said rod;

a washer of predetermined thickness positioned on said rod member between said locknut and said foot member;

a low-friction material of predetermined thickness positioned around said rod between said metal washer and said foot member; and wherein the distance between said annular surface and said locknut is greater than the total of said length of said upper portion of said fourth opening and the combined thicknesses of said washer and said low-friction material to permit said foot member to move axially, to pivot and to rotate with respect to said rod's axis.

12. Apparatus as in claim 11 wherein said bottom surface of said foot member is comprised of a low-friction material.

13. Apparatus as in claim 12 wherein said low-friction material is comprised of polytetrafluoroethylene.

14. Apparatus as in claim 1 wherein said flange member includes upper and lower portions and wherein said lower portion extends outwardly from said upper portion a distance substantially equal to the thickness of a standard wallboard panel.

15. Apparatus as in claim 3 wherein said spacer member edge element is positioned a greater distance from a predetermined one of said second plurality of supports than is a predetermined one of said first plurality of supports.

16. A wallboard jack and holding apparatus comprising:

a first housing having a first plurality of supports and a top wall member connected to predetermined ones of said supports, said top wall member defining a first threaded opening therein;

a rod extending through said first opening and defining an exterior, threaded surface threadably engaging said first opening and further defining a longitudinal axis and first and second ends;

a foot member connected to said first end of said rod;

a handle connected to said second end of said rod;

a flange member connected to a first one of said supports; and wherein predetermined of said first plurality of supports define bottom surfaces that are slanted from one of said first plurality of supports toward another of said first plurality of supports.

* * * * *